United States Patent [19]

Herr

[11] 4,286,633

[45] Sep. 1, 1981

[54] DROPPER ASSEMBLY

[75] Inventor: James E. Herr, East Petersburg, Pa.

[73] Assignee: Kerr Glass Manufacturing Corporation, Los Angeles, Calif.

[21] Appl. No.: 74,905

[22] Filed: Sep. 12, 1979

[51] Int. Cl.[3] ..... B65B 3/04

[52] U.S. Cl. ..... 141/24; 215/220

[58] Field of Search ..... 215/220; 141/24, 1, 141/2, 18–23, 25–31

[56] References Cited

U.S. PATENT DOCUMENTS

| | | | |
|---|---|---|---|
| 3,881,624 | 5/1975 | Dougherty | 141/24 |
| 4,056,129 | 11/1977 | Weiler et al. | 141/24 |
| 4,165,813 | 8/1979 | Babiol | 215/220 |

*Primary Examiner*—Houston S. Bell, Jr.

*Attorney, Agent, or Firm*—Fitch, Even, Tabin, Flannery & Welsh

[57] ABSTRACT

A squeeze bulb dropper assembly is combined with a child resistant closure to form an assembly which cannot be readily removed by younger children. The assembly provides a vapor proof and leakproof connection with the bottle. The preferred assembly employs a closure having an outer cap and an inner cap in which the inner cap rotates with the outer cap in an application direction, but remains stationary relative to a bottle to which it is engaged when the outer cap is rotated in a removal direction unless a simultaneous downward force is applied to the outer cap to intermesh cooperating members on the caps. The closure includes a dropper bulb disposed through the caps so that a resilient compressible flange on the bulb provides the spacing between the cooperating members of the caps unless a downward pressure on the outer cap compresses the flange.

8 Claims, 5 Drawing Figures

DROPPER ASSEMBLY

BACKGROUND OF THE INVENTION

This invention relates to a squeeze bulb dropper assembly for containers or bottles having small dosages of liquid to be dispensed.

Generally speaking, the liquid contents of such bottles is a form of medicine which should not be ingested by small children unless given to them by an adult in the proper dosage. However, a child may, with conventional medicine dropper and bottle assemblies, remove the closure from the bottle merely by unscrewing the same and thereby gaining access to the entire contents of the bottle. Generally, such liquid medicines must be capped by closure-dropper assemblies which are both vapor proof and leak proof.

Need to protect young children from the consequences of opening containers containing dangerous chemicals has been increasingly recognized by society in recent years and has been reflected by numerous governmental regulations mandating child-proof containers. While numerous child-proof closures have been developed, the need exists for adapting this technology to medicine dropper assemblies.

Because dropper bottle assemblies such as those used to dispense pharmaceuticals are generally intended to be used only until the bottle is empty and then discarded, the closure must be reusable. Also, it is important that such a closure be made simply and cheaply. In line with this it is desirable that bottle caps may be adapted to existing mass production machinery, including automatic closure applying or capping apparatus.

Accordingly, it is a general object of the present invention to provide a child-resistant closure-dropper assembly.

A further object of the invention is to provide a new and improved child-resistant closure-dropper assembly having inner and outer caps which must be manipulated in a predetermined manner before gaining access to the container.

Figure 1:
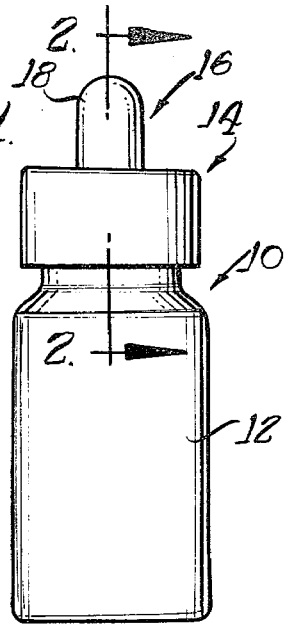
FIG. 1 is an elevation view of a bottle and dropper assembly.
Figure 2:
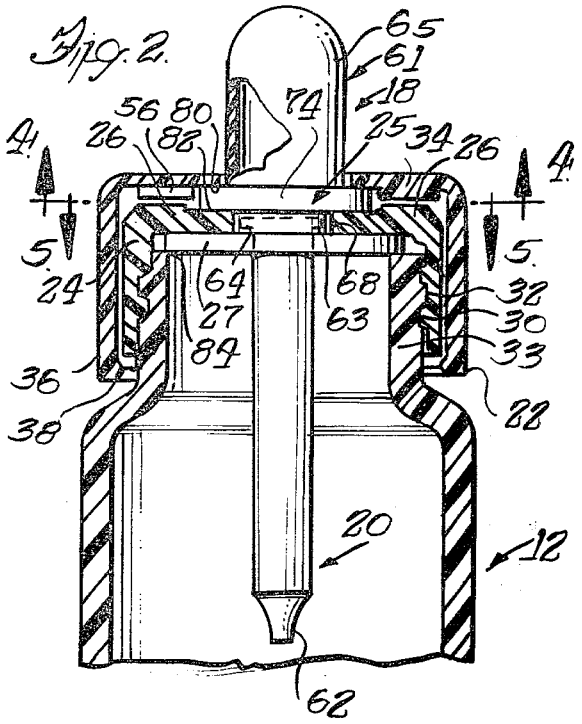
FIG. 2 is a fragmentary view partially in section of a bottle closure-dropper assembly.
Figure 3:
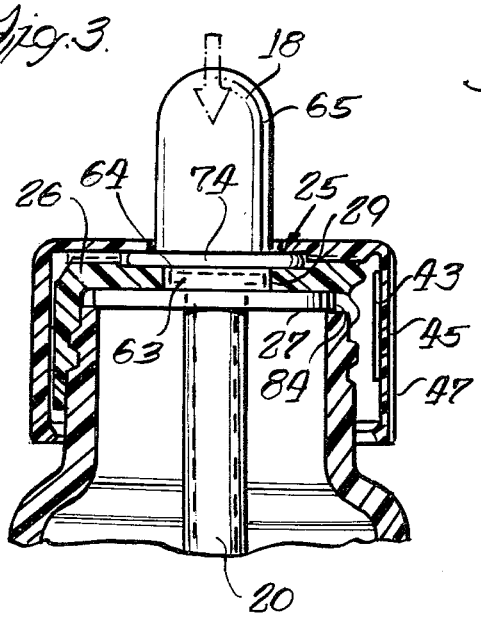
FIG. 3 is a fragmentary view partially in section similar to FIG. 2 with a downward force applied to the upper cap.
Figure 4:
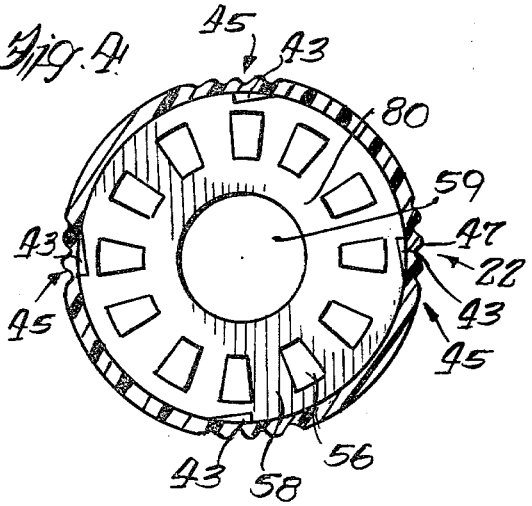
FIG. 4 is a view of the inside upper end of the outer cap.

In FIG. 1 is illustrated a dropper bottle assembly 10 including a bottle or container 12, a closure 14, and a dropper means or assembly 16 supported within the closure 14. The dropper assembly 16 consists of a bulb 18 formed from resilient material and a syringe 20 or tube held in the bulb opening.

Heretofore, such dropper bottle assemblies have not been child safe in that a child may readily twist the closure and dropper assembly from the threaded bottle 12 and use the contents. Thus, there is a need for a child-proof construction which is simple to manufacture and preferably of proven child-proof design. Further, the closure-dropper assembly must be vapor proof and leak proof so that the bottle ingredients are not lost or contaminated.

In accordance with the present invention, a child-proof dropper closure 14 is formed by combining the dropper means 16 with a two-piece closure having inner and outer caps 24 and 22 in which the outer cap 22 turns freely without removing the inner cap 24 when a turning torque only is applied in the removal direction. The caps 22 and 24 are spaced to a non-driving position by a resilient and compressible portion 25 of the dropper bulb means disposed between said caps. Preferably, the dropper means also has a lower sealing flange 27 of resilient material for sealing engagement with the container 12 to prevent leaking of the container liquid contents when the dropper closure is applied to the container. Preferably, the resilient portion 25 is also in the form of a flange spaced from the sealing flange 27 to define a groove 29 to receive therein a portion of the inner cap for the purpose of interlocking the dropper means with the caps. The resilient portion 25 also seals about orifices in the upper and lower caps to prevent entrance of foreign material into the bottle. Thus, the closure-dropper assembly is both leak proof and vapor proof.

The closure 14 disclosed herein is a modification of the closure described in U.S. Pat. No. 3,863,796 which is a commercially successful and proven design of child resistant closure. In this patented closure the inner and outer caps are spaced by a pair of centrally abutted dome means with the dome means on the outer cap 22 being preferably in the form of segmented flexible ring segments integrally molded to the outer cap. As an aid to understanding the invention, the structure of the inner and outer caps will now be given in detail.

The inner cap 24 consists of a circular top end 26 with a cylindrical shaped skirt 28 depending downward from top end 26. Thread 30 on the interior cylindrical wall of the inner cap 24 engages cooperating thread 32 on the neck 33 of the bottle 12 when the closure 14 is turned in an application direction (which is clockwise when viewed from the top of the closure in the drawing).

The inner cap 24 is preferably molded from relatively hard non-yielding plastic materials such as polystyrene, polypropylene or the like and the thread 30 therein is integrally molded on the inner side wall of the skirt 28. The non-yielding plastic provides resistance to removal when the inner cap 24 is screwed on the bottle 12.

The outer cap 22 consists of a circular top end 34 and a cylindrical shaped skirt 36 depending downward from the top end 34. The skirt 36 of the outer cap 22 is sufficiently long to extend beyond the bottom of the skirt 28 of the inner cap 24 so that the inner cap 24 is completely covered by the outer cap 22 thus preventing the closure 14 from being removed by manipulating the lower cap 24.

An annular lip 38 at the bottom of the inside wall of the skirt 36 of the outer cap 22 having an inside diameter less than the outside diameter of the skirt 28 of the inner cap 24 is positioned below the skirt 28 of the inner cap 24 to hold the inner cap 24 within the outer cap 22. An annular lip (not shown) at the bottom of the outer wall of the skirt 28 of the inner cap 24 may also be provided to cooperate with the lip 38 of the outer cap 22 to hold the caps together. The outer cap 22 is preferably formed in a single piece by molding a relatively flexible resilient plastic such as polyethylene or polypropylene. The flexibility of the outer cap 22 allows the lip 38 of the outer cap to be snapped over the inner cap 24.

Figure 5:
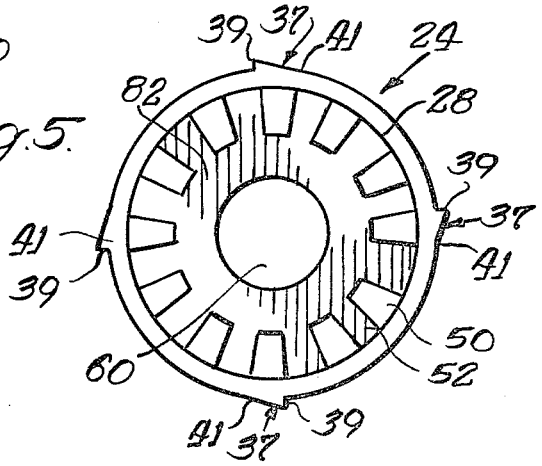
FIG. 5 is a plan view of the inner cap.

In order to prevent removal of the closure 14 and dropper assembly 16 allowing access by small children to the contents, the closure is made so that it cannot be removed merely by turning the outer cap 22 in a removal direction. The closure may, however, be applied merely by turning the outer cap 22 in an application direction. This is preferably accomplished by a ratchet means formed on the facing interior walls of the skirts 28 and 36. Herein the outer wall of the inner skirt 28 and inner wall of the outer skirt 36 each have one or more cooperating ratchet teeth as best seen in FIG. 5, the inner skirt has multiple ratchet teeth 37. Each ratchet tooth has a catching surface 39 generally perpendicular to the line tangent to the wall of the respective skirt and a slipping surface 41 at an acute angle to a line tangent to the respective wall. Multiple similar ratchet teeth 43 are formed on the interiorly facing surface of the outer cap skirt 36. The catching surfaces of the teeth of the inner skirt are faced to the catching surfaces of the outer skirt so that when the outer cap 22 is rotated in an application direction, catching surfaces on the outer cap 22 come into surface contact with catching surfaces on the inner cap 24 so that the inner cap 24 rotates in the application direction with the outer cap 22 to apply the closure 14 to the bottle 12. When the outer cap 22 is turned in the removal direction the sliding surfaces of the ratchet teeth of the outer 36 and inner 28 skirts slide over each other so that rotation of the outer cap 22 allows the inner cap 24 to remain stationary relative to the bottle 12 provided the inner cap 24 is sufficiently tightly engaged to the bottle 12 so that the torque produced on the inner cap during back ratcheting will be insufficient to overcome the initial resistance between the thread 30 of the closure 14 and the thread 32 of the bottle. To enhance the removal direction slipping between the outer 22 and the inner 24 caps, the resilient outer skirt 36 has a reduced thickness portion 45 at each of the ratchet teeth 43 and has a pair of outer ribs 47 opposite the ratchet teeth to facilitate gripping by an automatic closure applying apparatus, as described more fully in U.S. Pat. No. 3,863,796.

To permit the closure 14 to be removed from the bottle 12 intermeshing teeth are provided between the inner cap and outer cap so that when meshed, turning the outer cap 22 in a removal direction will rotate the inner cap 24. The upper surface of the top end 26 of the inner cap 24 includes a plurality of radially extending teeth 50. The teeth 50 have a generally trapezoidal shape and are spaced apart providing generally trapezoidal slots 52 therebetween. Similarly the lower surface of the top end 34 of the outer cap 22 includes a plurality of radially extending generally trapezoidal teeth 56 providing generally trapezoidal slots 58 therebetween. The teeth 50 and 56 are spaced sufficiently far apart so that the teeth 56 of the outer cap may fit between the teeth 50 of the inner cap 24. When the teeth 50 and 56 are intermeshed, rotational torque on the outer cap 22 is transmitted to the inner cap 24 so that the inner cap 24 turns with the outer cap 22.

Top ends 34 and 26 of the respective caps 22 and 24 are spaced apart so that the teeth 56 and 50 do not intermesh unless a downward force is applied to the outer cap 22. In ordinary bottle caps this has been accomplished in a variety of ways. Domes have been provided in the center of the upper surface of the top end of an inner cap to space the top ends of the caps apart so that downward pressure on the periphery of the resilient outer cap meshes the teeth. Alternatively, a flexible segmented ring has been additionally provided extending from the center of the top end of the outer cap so that downward pressure on the outer cap spreads and flattens the ring segments around a dome on the inner cap and meshes the teeth.

The upper ends 34 and 26 of caps 22 and 24 of instant closure 14 have no center portions for devices such as domes or segmented rings. Centrally located orifices 59 and 60 in the upper ends 34 and 26 of the outer 22 and inner 24 caps admit therethrough the dropper assembly 16.

The spacing between the top ends 26 and 34 is provided instead by the dropper bulb 18. The illustrated dropper assembly is formed of two pieces including an upper body 61 of resilient material such as rubber and the lower tube 20 of glass or plastic. Herein, the tube 20 is cylindrical with a hollow interior extending from a lower tip 62 to an upper enlarged diameter end 63 which is force fitted into a lower portion of the hollow bulb or nipple 18 so that the enlarged diameter end 63 fits into an annular groove 64 located in the interior wall of the bulb 18 between the upper 25 and lower 27 flange. The syringe or tube 20 may have various other shapes and/or manners of connection to the bulb and still fall within the purview of the present invention.

The upper body 61 also has the heretofore described annular compressible portion 25 which is preferably in the form of an annular flange 74 formed integral with the upper nipple 65 and the lower sealing flange 27. While other shapes of compressible portions could be used to bias the outer cap 22 upwardly from the lower cap, the flange shape is preferred as it seals the opening in the upper cap and likewise seals the lower opening in the lower cap. Preferably the top ends 26 and 34 of both the outer 22 and inner 24 caps have a flat annular area 80 and 82 between the orifice 59 and 60 and the teeth 56 and 50 to seat the upper flange 74 therebetween. However, it is sufficient that a flat area 82 be provided on the inner cap 24 with the teeth 56 on the outer cap 22 extending from the orifice 59.

The entire bulb 18 is a unitary piece formed of resilient material and the upper flange 72 is therefore compressible. Sufficient downward pressure on the outer cap 22 compresses the upper flange 74 meshing the teeth 50 and 56 into slots 58 and 52 so that the closure 14 may be removed by applying a simultaneous torque on the outer cap 22 in the removal direction.

The lower flange 27 is spaced from the upper flange 74 a distance generally equal to the thickness of the top end 26 of the inner cap 24. A cylindrical wall 68 joins the upper and lower flanges and defines therewith the annular groove 29. The upper flange 74 is sufficiently flexible that it may be pushed through the smaller diameter orifice 60 in the lower cap and then allowed to expand when assembling the dropper assembly to the closure. The lower flange 27 has an outside diameter generally equal to the inside diameter of the skirt 26 of the inner cap 24 and extends over the lip 84 of the bottle 12 to seal the bottle 12. Because the lower flange 27 is compressible, the closure 14 may be tightened on the bottle 12 to compress the lower flange 27 so that not only is a good seal provided, but resistance to removal is increased helping to insure that rotation of the outer cap 22 without simultaneous downward pressure will not remove the closure 14.

The use of a flange 74 of the bulb 18 as the spacing means obviates the necessity for spacing means to be provided on the caps 22 and 24 themselves. Domes or segmented rings are not needed on the caps 22 and 24. The design of the caps is therefore significantly simplified. Each feature added to a molded item requires increasingly complex and hence more expensive dies. Simplicity is desirable in a molded item since each feature of a molded item may potentially be miscast to create a rejected or unsafe unit. Therefore the dropper assembly closure which uses simplified outer and inner caps, provides additional reliability while using less expensively produced caps.

The functioning of spacing means molded on the outer and inner caps depends on the limited flexibility of the outer cap. The caps must be spaced sufficiently apart so that a small child cannot mesh the teeth, yet sufficiently close so that an adult or older child may remove the closure with little difficulty. Relatively strict production tolerances are needed to insure the proper spacing. In the dropper assembly closure the bulb 18 which is much more resilient than the outer cap provides the spacing, and, therefore, the caps 22 and 24 may be spaced farther apart to prevent accidental opening by a small child while allowing the same ease of access to the older child or adult.

The increased spacing between the caps 22 and 24 gives reliability with somewhat relaxed tolerances thereby decreasing the number of rejected units.

The closure 14 retains proven reliable safety features of known safety closures. Designs of ratchet teeth, for example, which is the feature that in fact makes a closure child-proof, are well known, use-tested, and proven reliable.

The closure-dropper assembly is easily assembled. All of the component parts snap together. The upper flange 74 of the bulb 18 may be pulled through the orifice 60 in the inner cap 24 to snap into place with the top end 26 of the inner cap 24 between the flanges 74 and 76. The outer cap 22 snaps over the inner cap 24. The tube 20 slides into the bulb 18 to complete the closure-dropper assembly which may then be screwed by an automatic capping machine onto the bottle 12.

While the preferred embodiment has been shown and described, it will be understood that there is no intention to limit the invention to such disclosed embodiments. On the contrary, it is intended to cover all modifications and equivalent construction falling within the spirit and scope of the invention as defined in the appended claims.

Various features of the invention are set forth in the following claims.

I claim:

1. A child-resistant bottle closure dropper assembly comprising:

an outer cap with a top end wall having an opening therein and a skirt depending therefrom;

an inner cap concentric with said outer cap with a top end wall having an opening therein and a skirt depending therefrom, thread means on an inside wall of said skirt of said inner cap for engagement with cooperating thread means on a bottle;

first means on said caps for driving engagement to rotate said inner cap with said outer cap when said outer cap is rotated in an application direction and allowing said inner cap to remain stationary when said inner cap is engaged with the bottle and said outer cap is rotated in a removal directon;

second means on said caps positionable in a driving position for driving engagement to rotate said inner cap with said outer cap when said outer cap is rotated in the removal direction and positionable in a non-driving position;

a resilient portion of said dropper means being disposed between said inner and outer caps to position said second means in said non-driving position unless said resilient portion is compressed to allow said second means to shift to said driving position, said compressed resilient portion biasing said outer cap to position said second driving means in a non-driving position; and a dropper means extending through said openings in said caps and having a squeeze bulb extending upwardly of said outer cap and a tube extending downwardly from said caps and for engagement with liquid contents of a container.

2. A bottle closure-dropper assembly of claim 1 in which said resilient portion is a flange positioned between said top ends of said first and second caps, said flange sealing against the inner surface of said outer cap and sealing against the upper surface of said inner cap to seal the openings in the respective caps.

3. A bottle closure-dropper assembly of claim 2 in which a resilient sealing portion is formed on said dropper means for liquid tight sealing engagement with said container.

4. A child resistant bottle closure-dropper assembly comprising:

an outer cap with a top end wall and a skirt depending therefrom;

an inner cap concentric with said outer cap with a top end wall and a skirt depending therefrom, thread means on an inside wall of said skirt of said inner cap to engage with cooperating thread means on a bottle;

ratchet means on said caps positionable in a driving position for driving engagement to rotate said inner cap with said outer cap when said outer cap is rotated in an application direction and positionable in a non-driving position to allow said inner cap to remain stationary when said inner cap is engaged with the bottle and said outer cap is rotated in a removal direction;

interlocking members on said caps having driving engagement to rotate said inner cap with said outer cap when said outer cap is rotated in the removal direction;

orifices in the center of each of said top end walls of said caps;

a bulb of resilient material with an opening to receive a syringe therein, a nipple, and a compressible portion, said bulb extending through said orifices with said compressible portion disposed between said top ends and spacing said first interlocking member from said second interlocking member when said compressible portion is not compressed but allowing said interlocking members to engage when a downward force is applied to said outer cap compressing said portion, thereby, allowing said bottle closure-dropper assembly to be removed from the bottle by applying a simultaneous downward force and rotational torque in the removal direction on said outer cap, compression of said compressed resilient portion biasing said outer cap to return said interlocking members to a non-driving position to prevent removal of the closure by a child.

5. A bottle closure-dropper assembly according to claim 4 wherein said ratchet means comprises a plurality of teeth on an outer wall of said skirt of said inner cap and a plurality of teeth on an inner wall of said skirt of said outer cap, each of said teeth having a catching surface and a slipping surface so that said catching surfaces of said teeth on said inner wall engage with said catching surfaces of said teeth on said outer wall when said outer cap is rotated in an application direction and said slipping surfaces of said teeth of said inner wall slides against said slipping surfaces of said teeth of said outer wall when said outer wall is rotated in a removal direction.

6. A bottle closure-dropper assembly according to claim 4 wherein said first interlocking member includes a plurality of teeth extending radially from said orifice on a bottom side of said top end of said outer cap and said second interlocking member includes a plurality of teeth extending radially from said orifice on a top side of said top end of said inner cap.

7. A bottle closure-dropper assembly according to claim 4 where said bulb includes a sealing flange on the lower end thereof, said sealing flange disposed below said top end of said inner cap, said sealing flange forming a seal over a lip of the bottle when said bottle closure-dropper assembly is engaged with the bottle.

8. A combination of a bottle and a child resistant bottle closure-dropper assembly comprising;

a bottle with a hollow interior and a mouth with thread means therearound;

and a closure dropper assembly comprising;

an outer cap with a top end wall and a skirt depending therefrom;

an inner cap concentric with said outer cap with a top end wall and a skirt depending therefrom, thread means on an inside wall of said skirt of said inner cap to engage with said thread means on said bottle;

ratchet means on said caps positionable in a driving position for driving engagement to rotate said inner cap with said outer cap when said outer cap is rotated in an application direction and positionable in a non-driving position to allow said inner cap to remain stationary when said inner cap is engaged with said bottle and said outer cap is rotated in a removal direction;

interlocking members on said caps having driving engagement to rotate said inner cap with said outer cap when said outer cap is rotated in the removal direction;

orifices in the center of each of said top end walls of said caps;

a bulb of resilient material with an opening to receive a syringe therein, a nipple, and a compressible portion, said bulb extending through said orifices with said compressible portion disposed between said top ends and spacing said first interlocking member from said second interlocking member when said compressible portion is not compressed but allowing said interlocking members to engage when a downward force is applied to said outer cap compressing said portion, thereby allowing said bottle closure-dropper assembly to be removed from said bottle by applying a simultaneous downward force and rotational torque in the removal direction on said outer cap, compression of said compressed resilient portion biasing said outer cap to shift upwardly to space said interlocking members to prevent closure removal by a child.

* * * * *